US007988418B2

(12) United States Patent
Cunha et al.

(10) Patent No.: US 7,988,418 B2
(45) Date of Patent: Aug. 2, 2011

(54) MICROCIRCUITS FOR SMALL ENGINES

(75) Inventors: Frank J. Cunha, Avon, CT (US); William Abdel-Messeh, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 12/711,279

(22) Filed: Feb. 24, 2010

(65) Prior Publication Data

US 2010/0158669 A1 Jun. 24, 2010

Related U.S. Application Data

(63) Continuation of application No. 11/344,763, filed on Jan. 31, 2006, now Pat. No. 7,695,246.

(51) Int. Cl.
*F01D 5/18* (2006.01)

(52) U.S. Cl. ..... 416/96 R; 416/97 R; 416/193 A

(58) Field of Classification Search ..... 415/115; 416/96 R, 97 R, 193 A
See application file for complete search history.

(56) References Cited

U.S. PATENT DOCUMENTS

| | | | | |
|---|---|---|---|---|
| 2,820,266 | A | 1/1958 | Kohl | |
| 4,353,679 | A * | 10/1982 | Hauser | 415/115 |
| 4,559,001 | A | 12/1985 | Wiedenhofer et al. | |
| 4,596,512 | A | 6/1986 | Krauss et al. | |
| 5,413,458 | A | 5/1995 | Calderbank | |
| 5,667,359 | A | 9/1997 | Huber et al. | |
| 5,813,835 | A * | 9/1998 | Corsmeier et al. | 416/97 R |
| 5,848,876 | A * | 12/1998 | Tomita | 416/96 R |
| 6,019,579 | A * | 2/2000 | Fukuno et al. | 416/97 R |
| 6,079,946 | A | 6/2000 | Suenaga et al. | |
| 6,132,173 | A | 10/2000 | Tomita et al. | |
| 6,168,381 | B1 | 1/2001 | Reddy | |
| 6,210,111 | B1 | 4/2001 | Liang | |
| 6,247,896 | B1 | 6/2001 | Auxier et al. | |
| 6,390,774 | B1 | 5/2002 | Lewis et al. | |
| 6,932,571 | B2 | 8/2005 | Cunha et al. | |
| 7,144,220 | B2 | 12/2006 | Marcin, Jr. | |
| 7,147,439 | B2 | 12/2006 | Jacala et al. | |
| 7,217,092 | B2 | 5/2007 | Lee et al. | |
| 2003/0133795 | A1 | 7/2003 | Manning et al. | |
| 2005/0025623 | A1 | 2/2005 | Botrel et al. | |
| 2005/0100437 | A1 | 5/2005 | Phillips et al. | |

FOREIGN PATENT DOCUMENTS

| | | | |
|---|---|---|---|
| EP | 0122405 | A1 | 10/1984 |
| EP | 1561900 | A2 | 8/2005 |
| EP | 1577498 | A1 | 9/2005 |
| EP | 1726785 | A2 | 11/2006 |

* cited by examiner

*Primary Examiner* — Ninh H Nguyen
(74) *Attorney, Agent, or Firm* — Bachman & LaPointe, P.C.

(57) ABSTRACT

A turbine engine component for use in a small engine application has an airfoil portion having a root portion, a tip portion, a suction side wall, and a pressure side wall. The suction side wall and the pressure side wall have the same thickness. Still further, the turbine engine component has a platform with an internal cooling circuit.

6 Claims, 4 Drawing Sheets

MICROCIRCUITS FOR SMALL ENGINES

CROSS REFERENCE TO RELATED APPLICATIONS (S)

The instant application is a continuation application of allowed U.S. patent application Ser. No. 11/344,763, filed Jan. 31, 2006, entitled MICROCIRCUITS FOR SMALL ENGINES.

BACKGROUND OF THE INVENTION (1) Field of the Invention

The present invention relates to an improved design for a turbine engine component used in small engine applications and to a method for designing said turbine engine component.

(2) Prior Art

There are existing cooling schemes currently in operation for small engine applications. Even though the cooling technology for these designs has been very successful in the past, it has reached its culminating point in terms of durability. That is, to achieve superior cooling effectiveness, these designs have included many enhancing cooling features, such as turbulating trip strips, shaped film holes, pedestals, leading edge impingement before film, and double impingement trailing edges. For these designs, the overall cooling effectiveness can be plotted in durability maps as shown in FIG. 1, where the abscissa is the overall cooling effectiveness parameter and the ordinate is the film effectiveness parameter. The plotted lines correspond to the convective efficiency values from zero to unity. The overall cooling effectiveness is the key parameter for a blade durability design. The maximum value is unity, implying that the metal temperature is as low as the coolant temperature. This is not possible to achieve. The minimum value is zero where the metal temperature is as high as the gas relative temperature. In general, for conventional cooling designs, the overall cooling effectiveness is around 0.50. The film effectiveness parameters lie between full film coverage at unity and complete film decay without film traces, at zero film. The convective efficiency is a measure of heat pick-up or performance of the blade cooling circuit. In general, for advanced cooling designs, one targets high convective efficiency. However, trades are required as a balance between the ability of heat pick-up by the cooling circuit and the coolant temperature that characterizes the film cooling protection to the blade. This trade usually favors convective efficiency increases. For advanced designs, the target is to use design film parameters and convective efficiency to obtain an overall cooling efficiency of 0.8 or higher. From FIG. 1, it can be noted that the film parameter has increased from 0.3 to 0.5, and the convective efficiency has increased from 0.2 to 0.6, as one goes from conventional cooling to microcircuit cooling. As the overall cooling effectiveness increases from 0.5 to 0.8, cooling flow is allowed to be decreased by about 40% for the same external thermal load. This is particularly important for increasing turbine efficiency and overall cycle performance. Therefore, designers of cooling systems are driven to design a system that has the means to (1) increase film protection, (2) increase heat pick-up, and (3) reduce airfoil metal temperature, denoted here as the overall cooling effectiveness, all at the same time. This has been a difficult target. However, with the advent of refractory metal core technology, it is now possible to achieve all the requirements simultaneously.

SUMMARY OF THE INVENTION

In accordance with the present invention, a turbine engine component for use in a small engine application comprises an airfoil portion having a root portion, a tip portion, a suction side wall, and a pressure side wall. In a preferred embodiment, the suction side wall and the pressure side wall have the same thickness. Still further, the turbine engine component has a platform with an as-cast internal cooling circuit.

Further in accordance with the present invention, a method for designing a turbine engine component for use in a small engine application is provided. The method broadly comprises the steps of: designing an airfoil portion having a root portion, a tip portion, a first wall forming a suction side wall, a second wall forming a pressure side wall, and a main body cavity; and increasing a wall thickness of the first and second walls from a point near the root portion to a point near the tip portion.

Other details of the microcircuits for small engines, as well as other objects and advantages attendant thereto, are set forth in the following detailed description and the accompanying drawings wherein like references depict like elements.

BRIEF DESCRIPTION OF THE DRAWINGS

FIG. 7(*b*) is a sectional view showing improved wall thicknesses on the pressure and suction sides of the airfoil portion;

DETAILED DESCRIPTION OF THE PREFERRED EMBODIMENT(S)

Figure 1:
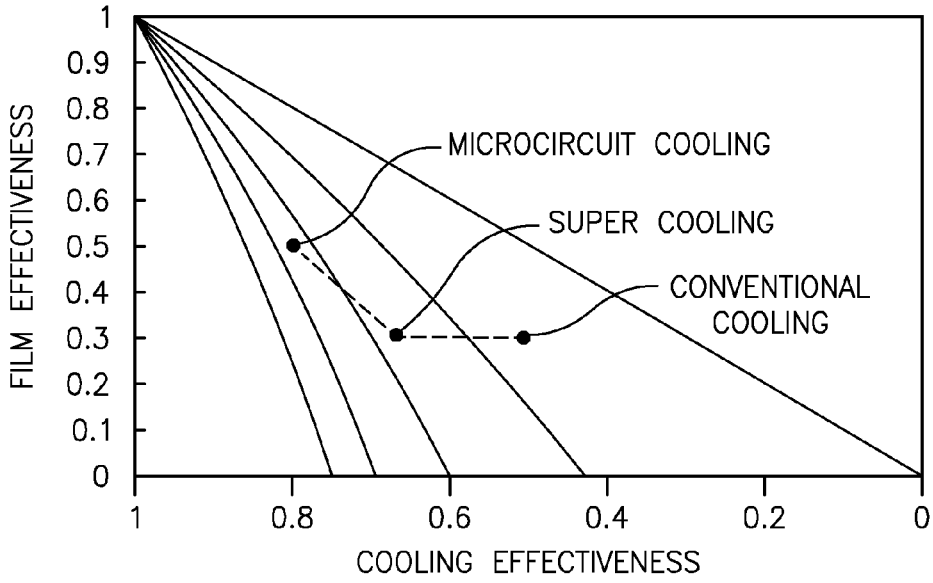
FIG. 1 is a durability map illustrating the path for higher overall cooling effectiveness from conventional to supercooling to microcircuit cooling.

Referring now to FIGS. 2-5, there is illustrated a cooling scheme for cooling a turbine engine component 10, such as a turbine blade or vane, which can be used in a small engine application. As can be seen from FIGS. 2 and 3, the turbine engine component 10 has an airfoil portion 12, a platform 14, and an attachment portion 15. The airfoil portion 12 includes a pressure side 16, a suction side 18, a leading edge 20, a trailing edge 22, a root portion 19, and a tip portion 21.

Figure 4:
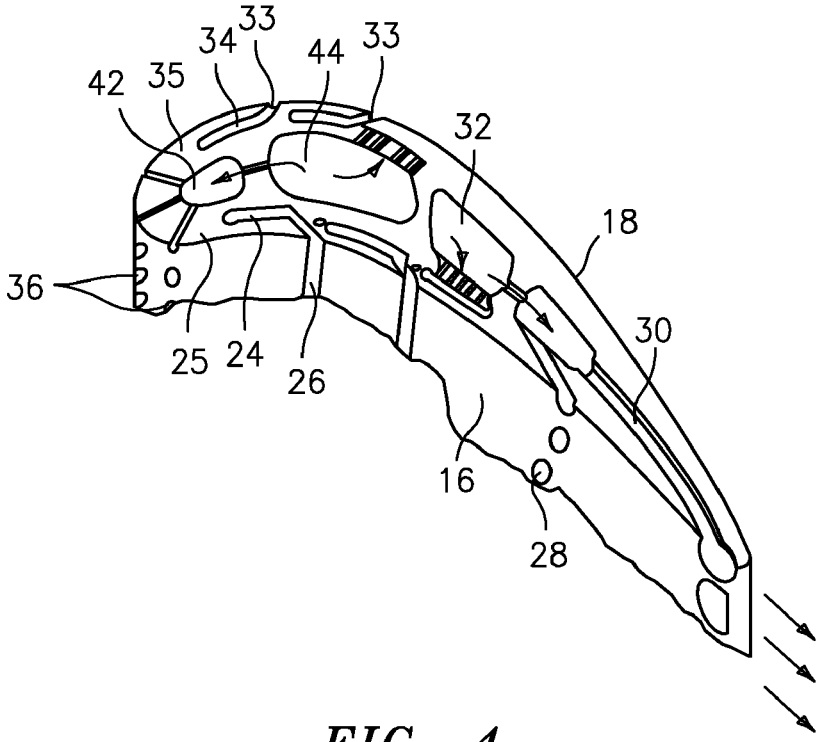
FIG. 4 is a sectional view of an airfoil portion of the turbine engine component taken along lines 4-4 in FIG. 2.

FIG. 4 is a sectional view of the airfoil portion 12. As shown therein, the pressure side 16 may include one or more cooling circuits or passages 24 with slot film cooling holes 26 for distributing cooling fluid over the pressure side 16 of the airfoil portion 12. The cooling circuit(s) or passage(s) 24 are embedded within the pressure side wall 25 and may be made using a refractory metal core (not shown), which refractory metal core may have one or more integrally formed tabs that form the cooling holes 26. The pressure side 16 also may have a plurality of shaped holes 28 which may be formed using non-refractory metal core technology. Typically, the cooling circuit(s) or passage(s) 24 extend from the root portion 19 to the tip portion 21 of the airfoil portion 12.

The trailing edge 22 of the airfoil portion 12 has a cooling microcircuit 30 which can be formed using refractory metal core technology or non-refractory metal core technology.

The airfoil portion 12 may have a first supply cavity 32 which is connected to inlets for the trailing edge cooling microcircuit 30 and for the cooling circuit(s) or passage(s) 24 to supply the circuits with a cooling fluid such as engine bleed air.

Figure 5:
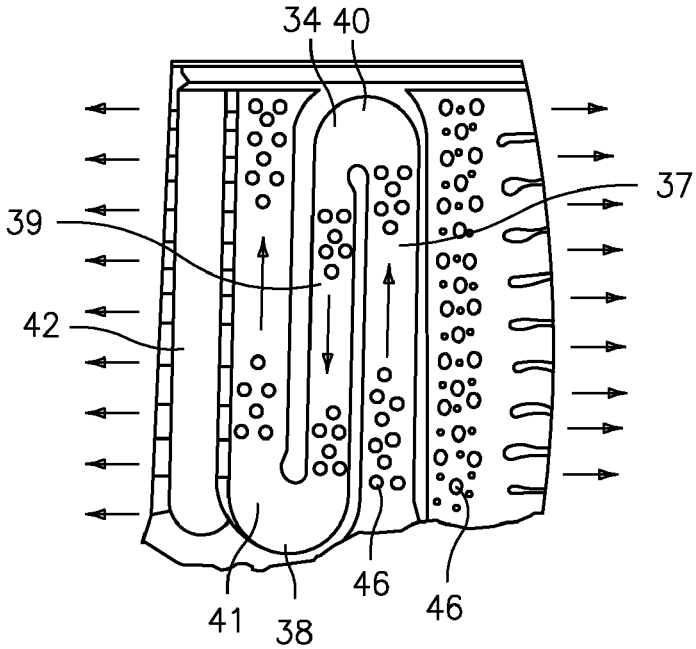
FIG. 5 is a sectional view of a serpentine configuration cooling system used in the turbine engine component of FIG. 2.

The suction side 18 of the airfoil portion 12 may have one or more cooling circuits or passages 34 positioned within the suction side wall 35. Each cooling circuit or passage 34 may be formed using refractory metal core(s) (not shown). Each refractory metal core may have one or more integrally formed tab elements for forming cooling film slots 33. As shown in FIG. 5, each cooling circuit or passage 34 may have a serpentine configuration with a root turn 38 and a tip turn 40. Further, a number of pedestal structures 46 may be provided within one or more of the legs 37, 39, and 41 to increase heat pick-up. The airfoil portion 12 may also have a second feed cavity 42 for supplying cooling fluid to a plurality of film cooling holes 36 in the leading edge 20 and a third supply cavity 44 for supplying cooling fluid to the leading edge and suction side cooling circuits 34 and 36.

Figure 2:
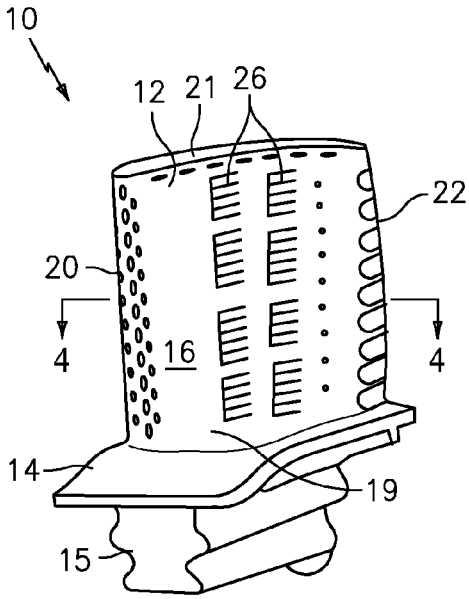
FIG. 2 illustrates a turbine engine component and its pressure side.
Figure 3:
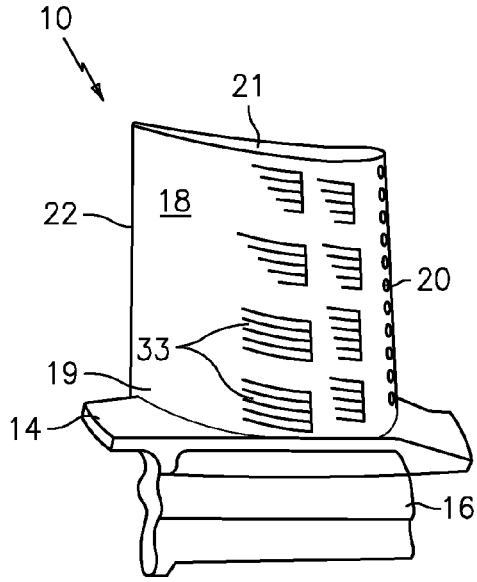
FIG. 3 illustrates the turbine engine component of FIG. 2 and its suction side.

As shown in FIG. 2, the pressure side cooling film traces with high coverage from the cooling holes 26. Similarly, as shown in FIG. 3, the suction side cooling film traces with high coverage from the film slots 33. The high coverage film is the result of the slots formed using the refractory metal core tabs. The heat pick-up or convective efficiency is the result of the peripheral cooling with many turns and pedestals 46, as heat transfer enhancing mechanisms.

Figure 6A:
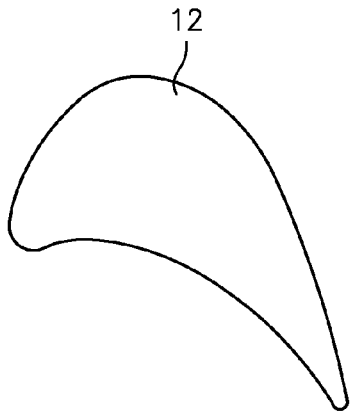
FIGS. 6(*a*)-6(*c*) illustrate the cross sectional areas of an airfoil portion of the turbine engine component at 10%, 50%, and 90% radial spans.
Figure 6B:
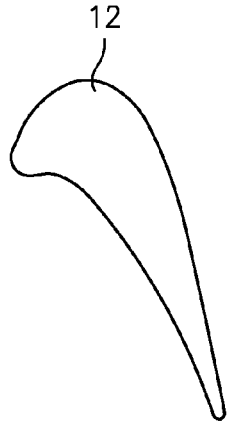
Figure 6C:
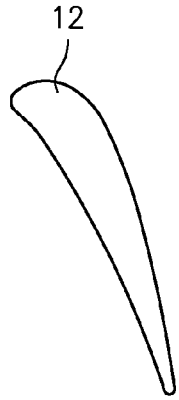
Figure 7A:
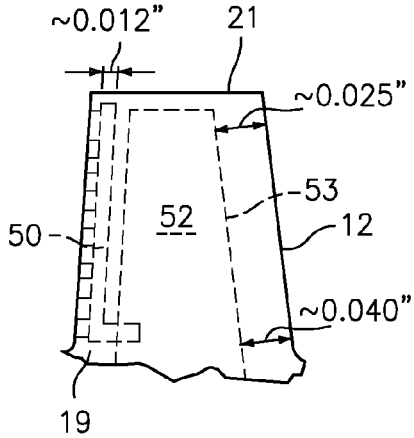
FIG. 7(*a*) is a sectional view showing wall thicknesses on the pressure and suction sides of the airfoil portion.
Figure 7B:
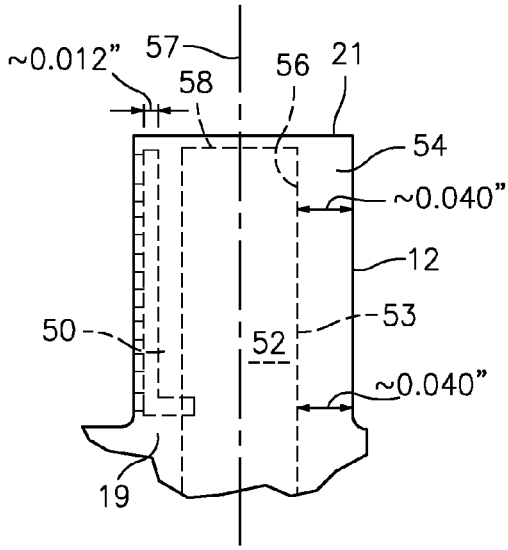

Since the airfoil portions 12 in small engine applications are relatively small, packaging one or more refractory metal core(s) used to form the peripheral cooling circuits along with the main body traditional silica cores used to form the main supply cavities can be difficult. This is due to the decreasing cross-sectional area as illustrated in FIGS. 6(*a*)-6(*c*). FIG. 6(*a*) shows the cross-sectional area of the airfoil portion 12 at 10% radial span. FIG. 6(*b*) shows the cross-sectional area of the airfoil portion 12 at 50% radial span. FIG. 6(*c*) shows the cross-sectional area of the airfoil portion 12 at 90% radial span. As can be seen from these figures, the cross-sectional area of the airfoil portion significantly decreases as one moves from the root portion 19 towards the tip portion 21. FIG. 7(*a*) illustrates the wall thicknesses available for packaging a refractory metal core 50 used to form a cooling microcircuit on either a pressure side or suction side of the airfoil portion 12 and the main silica body core 52 used to form a central supply cavity 53 when using standard root to tip tapering having a taper angle of about 6 degrees or less. As used herein, the taper angle is the inverse-tangent of the axial offset between the root and the tip sections at the leading edge over the blade span. As can be seen from this figure, the packaging is very difficult.

To facilitate the packaging for the refractory metal core(s) 50 used to form the cooling microcircuit(s) on the suction and/or pressure side of the airfoil portion 12 and the silica main body core 52 used to form a central supply cavity 53, it is desirable to increase the cross sectional area. FIG. 7(*b*) illustrates one approach for increasing the cross sectional area of the airfoil portion 12. As can be seen from FIG. 7(*b*), an airfoil portion 12 in accordance with the present invention has less root-to-tip taper, i.e. about 2 degrees or less. As a result, a refractory metal core 50 having a thickness of approximately 0.012 inches may be placed more easily in the airfoil portion 12 whose available wall thickness 54 can be increased from 0.025 inches to 0.040 inches by using this approach. At the same time, the main body core 52 for forming the cavity 53 can be re-shaped to address structural and vibrational requirements. As can be seen from FIG. 7(*b*), the main body core 52 can have side walls 56 which are substantially parallel to the longitudinal axis 57 of the airfoil portion and an end portion 58 which is substantially perpendicular to the longitudinal axis 57. If desired, the main body core 52 can be tapered to address structural and vibrational requirements. The tapering of the main body core allows control of the balance between decreasing the metal volume above a certain blade radius while maintaining the minimum cross sectional area to minimize the centrifugal stress for a given metal temperature.

As the relative gas temperature increases to levels never achieved before, several modes of distress may be introduced in the turbine engine component 10 due to the lack of cooling. For example, the platform 14 may undergo distress, such as platform curling and creep, as a result of a lack of platform cooling. Platforms used on turbine engine components for small engine applications are usually very thin and cooling is extremely difficult to implement. Due to the small sizes afforded by the thickness of refractory metal cores, it is now possible to incorporate as-cast internal cooling circuits into a platform 14 during casting of the turbine engine component 10 and the platform 14 by using refractory metal core technology.

Figure 8:
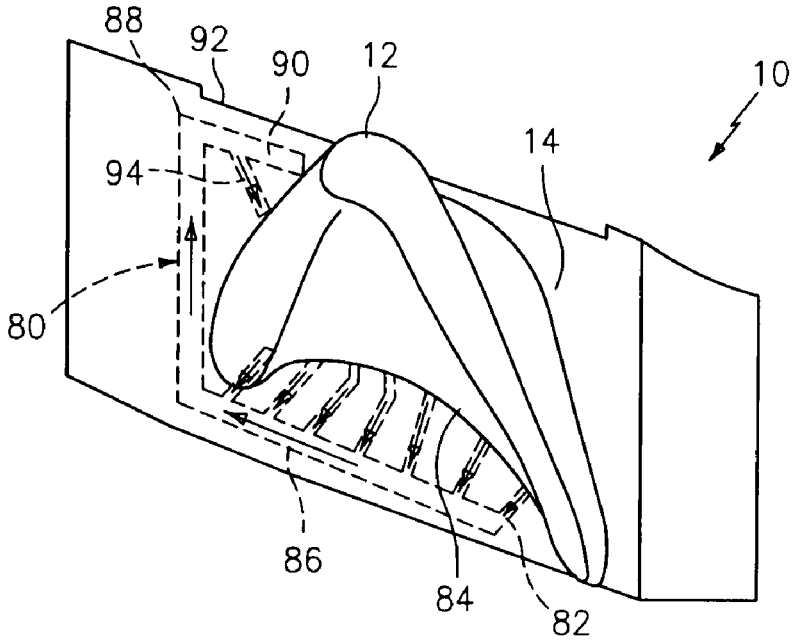
FIG. 8 is a schematic representation of a cooling microcircuit for a platform.
Figure 9:
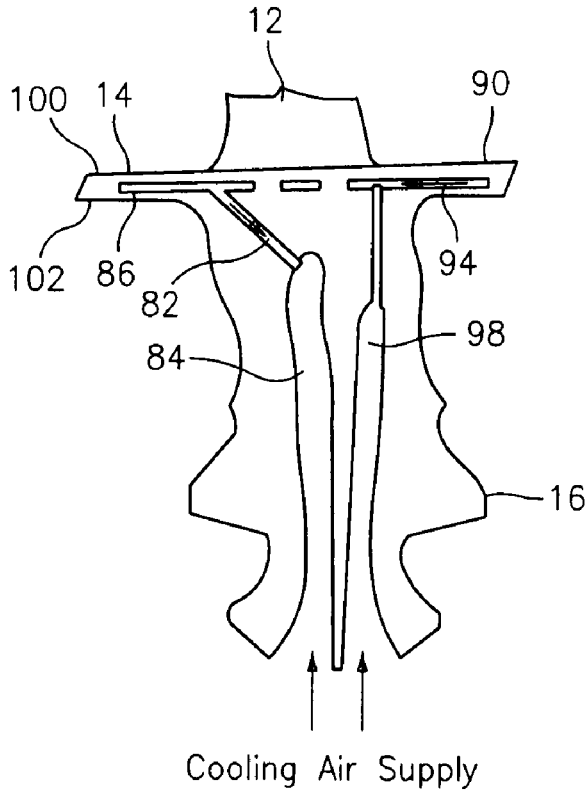
FIG. 9 is a sectional view of the turbine engine component showing the cooling circuit in the platform.

Referring now to FIGS. 8 and 9, there is shown a turbine engine component 10 having a platform 14 with an internal cooling circuit 80. The cooling circuit 80 may have one or more inlets 82 which run from an internal pressure side fed blade supply 84. The inlets 82 may supply cooling fluid to a first channel leg 86 positioned at an angle to the inlets 82. The circuit 80 may have a transverse leg 88 which communicates with the leg 86 and an opposite side leg 90 which communicates with the transverse leg 88. The opposite side leg 90 may extend along an edge 92 of the platform 14 any desired distance. A plurality of return legs 94 may communicate with the side leg 90 for returning the cooling fluid along the suction side main body core 98. The returned cooling air could then be used to cool portions of the airfoil portion 12.

As can be seen from the foregoing description, the internal cooling circuit 80 is capable of effectively cooling the platform 14. While the cooling circuit 80 has been described and shown as having a particular configuration, it should be noted that the cooling circuit 80 may have any desired configuration. To increase heat pick-up, the various portions of the cooling circuit 80 may be provided with a plurality of pedestals (not shown).

The internal cooling circuit 80 may be formed by providing a refractory metal core in the shape of the desired cooling circuit 80. The refractory metal core may be formed from any suitable refractory material known in the art such as molybdenum or a molybdenum alloy. The refractory metal core may be placed into the die used to form the turbine engine component 10 and the platform 14 and may be held in place by a wax pattern (not shown). Molten metal, such as a nickel based superalloy, may then be introduced into the die. After the molten metal has solidified and the turbine engine component 10 including the exterior surfaces of the airfoil portion 12, the exterior surfaces 100 and 102 of the platform 14, and the attachment portion 16 have been formed, the refractory metal core used to form the cooling circuit 80 may be removed using any suitable technique known in the art, thus leaving the internal cooling circuit 80.

In general, the suction side main body core(s) feed film holes on the suction side of the airfoil portion 12 with lower sink pressures. As a result, there is a natural pressure gradient between the pressure side supply and the suction side exits to force the flow through platform cooling circuit 80.

It is apparent that there has been provided in accordance with the present invention microcircuits for small engines which fully satisfies the objects, means, and advantages set forth hereinbefore. While the present invention has been described in the context of specific embodiments thereof, unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A platform of a turbine engine component comprising:

exterior walls and an as-cast cooling circuit positioned entirely within said platform internally of said exterior walls for cooling said platform; and said cooling circuit having a first leg which extends along a pressure side edge of said platform, a second leg which extends along a suction side edge of said platform, and a transverse leg which extends between said first leg and second leg, wherein cooling fluid enters said first leg and traverse a length of said first leg, flows into said transverse leg after completing said traverse of said first leg length, and then flows into said second leg.

2. The platform according to claim 1, wherein said cooling circuit has at least one inlet which runs from an internal pressure side feed supply.

3. The platform according to claim 2, wherein said internal cooling circuit has a plurality of inlets which run from said internal pressure side feed supply to said first leg.

4. The platform according to claim 1, wherein said first leg is positioned at an angle to the at least one inlet.

5. The platform according to claim 4, wherein said internal cooling circuit further has at least one return leg extending from said second leg for returning cooling fluid along a suction side main body core.

6. The platform according to claim 5, wherein said internal cooling circuit has a plurality of return legs extending from said second leg.

* * * * *